US008185001B2

(12) United States Patent
Matsumoto

(10) Patent No.: US 8,185,001 B2
(45) Date of Patent: May 22, 2012

(54) IMAGE FORMING APPARATUS AND METHOD

(75) Inventor: Keiko Matsumoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 389 days.

(21) Appl. No.: 12/495,192

(22) Filed: Jun. 30, 2009

(65) Prior Publication Data

US 2010/0008684 A1 Jan. 14, 2010

(30) Foreign Application Priority Data

Jul. 9, 2008 (JP) ..... 2008-178965

(51) Int. Cl.
*G03G 15/00* (2006.01)

(52) U.S. Cl. ..... 399/45

(58) Field of Classification Search ..... 399/45, 399/53

See application file for complete search history.

(56) References Cited

U.S. PATENT DOCUMENTS

| | | | | |
|---|---|---|---|---|
| 6,801,727 | B2 * | 10/2004 | Maruyama et al. | 399/45 |
| 7,676,169 | B2 * | 3/2010 | Denton et al. | 399/74 |
| 2007/0218381 | A1 * | 9/2007 | Uchinokura et al. | 430/108.1 |
| 2007/0280742 | A1 | 12/2007 | Matsumoto et al. | |
| 2008/0063434 | A1 | 3/2008 | Uno et al. | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0187332 | A1 | 8/2008 | Tsuda et al. | |
| 2008/0279592 | A1 | 11/2008 | Matsumoto et al. | |
| 2009/0016777 | A1 | 1/2009 | Miyamoto et al. | |
| 2009/0103935 | A1 | 4/2009 | Uno et al. | |
| 2009/0110425 | A1 | 4/2009 | Uno et al. | |

FOREIGN PATENT DOCUMENTS

| | | |
|---|---|---|
| JP | 2000-355443 | 12/2000 |
| JP | 2005-316440 | 11/2005 |
| JP | 2006-30978 | 2/2006 |
| JP | 2006-175611 | 7/2006 |
| JP | 2006-350079 | 12/2006 |
| JP | 3919618 | 2/2007 |

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus includes an image bearing member to bear an electrostatic latent image on its surface, a developing device to develop the electrostatic latent image using toner to form a toner image, a transfer device to transfer the toner image onto a recording medium, a fixing device to fix the toner image, a first detector to detect at least glossiness of a surface of the recording medium, a second detector to detect at least a space between asperities on the surface of the recording medium, and a controller to control an amount of toner when forming the toner image. The controller adjusts the amount of toner based on the glossiness of the recording medium detected by the first detector and the space between the asperities detected by the second detector.

14 Claims, 7 Drawing Sheets

IMAGE FORMING APPARATUS AND METHOD

CROSS-REFERENCE TO RELATED APPLICATIONS

This patent application is based on and claims priority pursuant to 35 U.S.C. §119 from Japanese Patent Application No. 2008-178965 filed on Jul. 9, 2008 in the Japan Patent Office, the entire contents of which are hereby incorporated herein by reference.

BACKGROUND OF THE INVENTION

1. Field of the Invention

Exemplary aspects of the present invention generally relate to an image forming apparatus, such as a copier, a facsimile machine, a printer, or a multi-functional system including a combination thereof, and a method of forming an image with the image forming apparatus.

2. Description of the Background Art

Conventionally, there is known an electrophotographic image forming apparatus in which types of recording media or paper can be designated and printing carried out under printing conditions suitable for the designated type of the recording medium or paper. Although advantageous, such an image forming apparatus suffers from a drawback in that the number of types of recording media that can be designated is limited, including for example only a thickness of the recording medium, an OHP sheet, and a type of a label sheet.

In recent years, in order to obtain high imaging quality similar to that obtained with traditional silver halide photography, use of high gloss coated paper is increasing. In order to form an image on the coated paper, there is known an image forming apparatus that is equipped with printing capabilities suitable for the coated paper so that printing can be performed on the coated paper.

Furthermore, in order to select the type of recording medium automatically, there is known an image forming apparatus that detects the degree of smoothness of the recording medium as reflectivity and prints under appropriate printing conditions.

In general, it is preferred that the image have a glossiness that is higher than the glossiness of the recording medium on which the image is fixed. When using such coated paper, in order to adequately fuse the toner that forms the image onto the recording medium so that a smooth toner image is obtained, a temperature of image fixation is raised and/or a time for image fixation is extended.

However, when the type of coated paper varies, high glossiness and a high quality image may not be achievable under given printing conditions. To address this problem, in one related-art image forming apparatus, it is determined whether the coated paper is normal high-gloss coated paper or thermoplastic resin coated paper. Printing conditions are changed in accordance with the result, thereby achieving a high-gloss image without degrading image quality.

It is known that, even under identical printing conditions, the quality of an image also differs between dull coated paper and matte coated paper. The glossiness of an image fixed on matte coated paper is not as great as that of an image fixed on dull coated paper. A surface roughness is also different between dull coated paper and matte coated paper, with distances between adjacent microscopic protrusions on the matte coated paper are greater than on dull coated paper.

Therefore, a toner layer too readily conforms to the rough surface of the coated paper. In this case, the image remains rough even after image fixation, so that it is difficult to obtain a high-gloss image.

An additional factor complicating the attainment of consistently smooth, high-quality images is that, in order to achieve such high-quality images, toner particle diameters are getting smaller. Toner particles having a small particle diameter are produced more easily using a pulverization method than a polymerization method. In the pulverization method, a particle diameter distribution of the toner particles is narrower than that of the polymerization method, and the shape of the toner particle can be made substantially spherical. However, such toner particles are deposited on the surface of the recording medium densely, and thus toner layers of uniform height are readily formed. As a result, the roughness of the recording medium remains even after image fixation.

SUMMARY OF THE INVENTION

In view of the foregoing, in one illustrative embodiment of the present invention, an image forming apparatus includes an image bearing member, a developing device, a transfer device, a fixing device to fix the toner image, a first detector, a second detector, and a controller. The image bearing member bears an electrostatic latent image on a surface thereof. The developing device develops the electrostatic latent image formed on the image bearing member using toner to form a toner image. The transfer device transfers the toner image onto a recording medium. The fixing device fixes the toner image. The first detector detects glossiness of a surface of the recording medium. The second detector detects a space between asperities on the surface of the recording medium. The controller controls an amount of toner when forming the toner image. The controller adjusts the amount of toner based on the glossiness of the recording medium detected by the first detector and the space between the asperities detected by the second detector.

In another illustrative embodiment of the present invention, an image forming apparatus includes the image bearing member, the developing device, the transfer device, the fixing device, a paper recognition device, the second detector, and a controller. The paper recognition device identifies a type of paper used as the recording medium. The controller adjusts the amount of the toner based on the type of paper used as the recording medium and the space between the asperities detected by the second detector.

Yet in another illustrative embodiment of the present invention, a method of forming an image includes bearing an electrostatic latent image on a surface of an image bearing member; developing the electrostatic latent image formed on the image bearing member using toner to form a toner image; transferring the toner image onto a recording medium; fixing the toner image; detecting at least glossiness of a surface of the recording medium; detecting at least a space between asperities on the surface of the recording medium; and adjusting an amount of toner when forming the toner image based on the glossiness of the recording medium detected in the detecting glossiness step and the space between the asperities detected in the detecting a space step.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
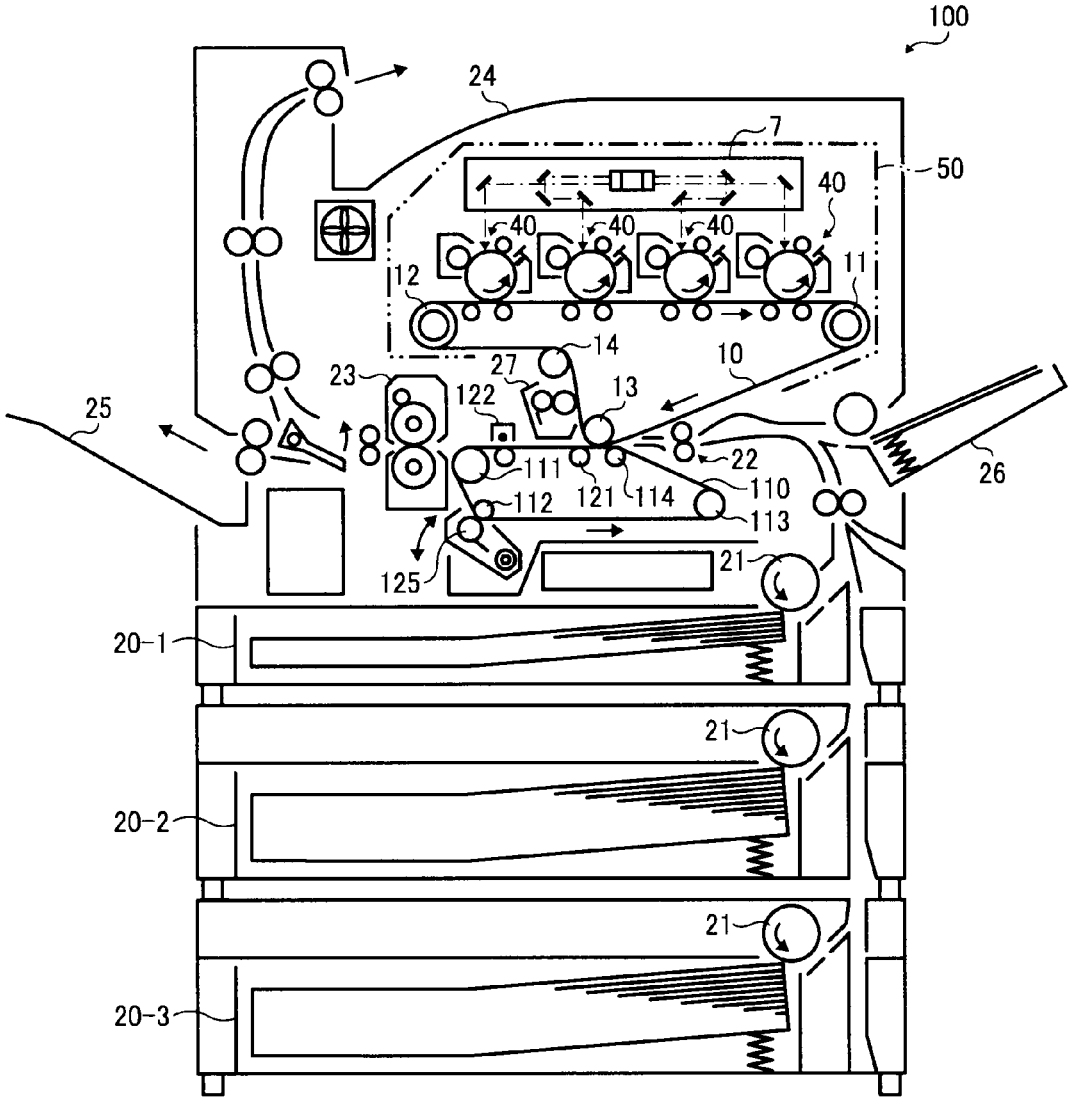
FIG. 1 is a schematic diagram illustrating an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating the image forming apparatus 100 according to the illustrative embodiment. The image forming apparatus 100 includes an image forming unit 50 substantially in the center thereof. The image forming unit 50 includes four rollers 11, 12, 13, and 14, an intermediate transfer belt 10 that is stretched between the four rollers 11 through 14, an exposure device 7, and four image forming stations 40.

The four image forming stations 40 are aligned and contact along the outer surface of the intermediate transfer belt 10. Substantially above the image forming stations 40, the exposure device 7 is provided. The image forming stations 40 all have the same configuration as all the others, differing only in the color of toner employed. Therefore, with reference to FIG. 2, a description is herein provided of one of the image forming stations 40 as a representative example of the image forming stations 40.

Figure 2:
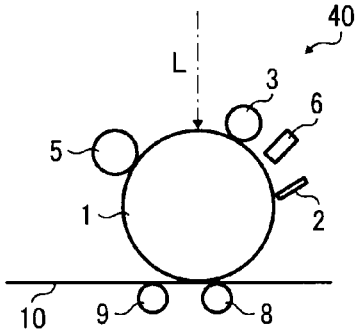
FIG. 2 is a schematic diagram illustrating one example of an image forming station of the image forming apparatus of FIG. 1.

Referring now to FIG. 2, there is provided a side view of the image forming station 40. In FIG. 2, the image forming station 40 includes a photoreceptor drum 1 serving as an image bearing member, a cleaning device 2, a charging device 3, a developing device 5, a charge neutralizing device 6, and so forth.

The developing device 5 of the image forming station 40 stores respective color of toner such as cyan, magenta, yellow, and black, and applies the toner to an electrostatic latent image formed on the photoreceptor drum 1.

A place between the charging device 3 and the developing device 5 is a writing position where a laser beam L emitted from the exposure device 7 illuminates. It is to be noted that the exposure device 7 is a known exposure device using a laser beam. According to the illustrative embodiment, the exposure device 7 illuminates the evenly-charged surface of the photoreceptor drum 1 with optical information separated into color components corresponding to the color of toner to develop as a latent image. Alternatively, an exposure device using an LED array and an imager can be employed.

The image forming station 40 includes a transfer roller 8 and a roller 9 that supports the intermediate transfer belt 10. The transfer roller 8 is disposed facing the photoreceptor drum 1 through the intermediate transfer belt 10. The toner image formed on the photoreceptor drum 1 is transferred onto the intermediate transfer belt 10 by the transfer roller 8.

All the components inside the loop of the transfer belt loop except the transfer roller 8 are connected to ground via a frame of the apparatus.

The image forming station 40 also includes a cleaning unit 27 that cleans the intermediate transfer belt 10.

A description is now provided of forming a full-color image. In the four image forming stations 40, the toner images of cyan, magenta, yellow, and black are formed on the respective color of photoreceptor drums 1. Subsequently, the toner images are sequentially overlappingly transferred onto the intermediate transfer belt 10, thereby forming a full-color image on the intermediate transfer belt 10.

When forming a monochrome image, the toner image of black is formed only in the image forming station 40 using the toner of black. The monochrome image is transferred onto the intermediate transfer belt 10.

Substantially below the image forming unit 50, a secondary intermediate transfer member 110 is provided. The secondary intermediate transfer member is a belt stretched between rollers 111, 112, 113, and 114, and rotatable in a counterclockwise direction indicated by an arrow in FIG. 1. The roller 114 is a driven roller. In the inner loop of the secondary intermediate transfer member 110, a transfer roller 121 serving as a transfer member is provided facing the roller 13 supporting the intermediate transfer belt 10 of the image forming unit 50.

Outside the belt loop, a belt cleaning unit 125 and a transfer charger 122 are provided. The intermediate transfer belt 10 and the secondary intermediate transfer member 110 contact each other by the transfer roller 121, the roller 114, and the roller 13, forming a transfer nip therebetween. Each component in the belt loop of the secondary intermediate transfer member except the transfer member is connected to ground via the frame of the apparatus as necessary.

Substantially at the bottom of the image forming apparatus 100, a sheet feeding unit including three sheet cassettes 20-1, 20-2, and 20-3, each of which stores recording media. The recording media in each of the cassettes 20-1, 20-2, and 20-3 are fed to a pair of the registration rollers 22 one sheet at a time from the top sheet. The recording medium manually fed from a manual sheet feeder 26 is also sent to the pair of the registration rollers 22.

Substantially at the left of the secondary intermediate transfer member 110, a fixing unit 23 is provided.

In the image forming apparatus 100 according to the illustrative embodiment, in a case of single side printing, the toner image formed in the image forming unit 50 is borne on the intermediate transfer belt 10 and transferred onto one side of the recording medium from the registration rollers 22.

After the toner image transferred onto one side of the recording medium, the recording medium is separated from the intermediate transfer belt 10 at the roller 13 due to curvature of the roller 13. The toner image is fixed on the recording medium by the fixing unit 23. After the toner image is fixed, the recording medium is discharged onto a sheet stack portion 24 or a sheet discharge tray 25 at a side of the image forming apparatus 100.

In a case of duplex printing, a first image formed in the image forming unit 50 is transferred from the intermediate transfer belt 10 to the secondary intermediate transfer member 110. Subsequently, a second image is formed in the image forming unit 50.

The second image is transferred from the intermediate transfer belt 10 to one side of the recording medium, that is, a second surface of the recording medium from the registration rollers 22. The transfer roller 121 provided in the inner loop of the secondary intermediate transfer member 110 causes the second image to be transferred to the second surface of the recording medium. At this time, the first image already transferred to and borne on the secondary intermediate transfer member 110 makes one full circle and is aligned with the first surface of the recording medium.

When the second image is transferred on the second surface of the recording medium and the first image is aligned with the other side thereof, that is, a first surface, the recording medium is transported in the left direction by the secondary intermediate transfer member 110. At the transfer charger 122, the transfer charger 122 causes the toner image (the first image) on the secondary intermediate transfer member 110 to be transferred onto the first surface of the recording medium.

When the images are transferred on both sides of the recording medium, curvature of the roller 111 causes the recording medium to separate from the secondary intermediate transfer member 100. Similar to the single-side printing, the fixing unit 23 fixes the toner image on the recording medium. After image fixation, the recording medium is discharged onto a sheet stack portion 40 or a sheet discharge tray 44.

Figure 3:
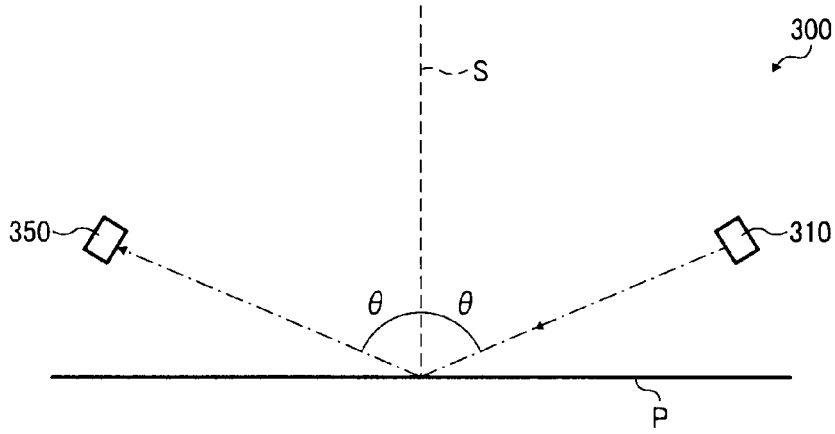
FIG. 3 is a schematic diagram illustrating a generally-known optical detector.

Generally, a surface of a recording medium is not smooth and includes asperities. In order to detect glossiness and roughness of the recording medium (a space between asperities on the recording medium), an optical detector 300 is generally used. FIG. 3 is a diagram schematically illustrating the generally-known optical detector 300 including a light emitter 31 and a light receiver 35. The optical detector 300 serves as a detector that detects glossiness and surface roughness of the recording medium.

As glossiness of the surface of the recording medium becomes less, specularly reflected light becomes also less. Thus, the optical detector 300 can identify glossiness of the recording medium based on intensity of the specularly reflected light. Furthermore, roughness of the recording medium, that is, a space between asperities on the surface thereof can be identified based on the intensity of both the specularly reflected light and a diffuse light.

As illustrated in FIG. 3, the generally-known optical detector 300 includes a pair of the light emitter 310 and the light receiver 350. The pair of the light emitter 310 and the light receiver 350 is disposed such that an angle θ is formed between a vertical line S and the light emitter 31, and between the vertical line S and the light receiver 35. The vertical line S is a line perpendicular to the recording medium P.

The light emitted from the light emitter 310 is reflected on the surface of the recording medium and includes specularly reflected light and diffuse light. The light receiver 350 receives the specularly reflected light.

Figure 4:
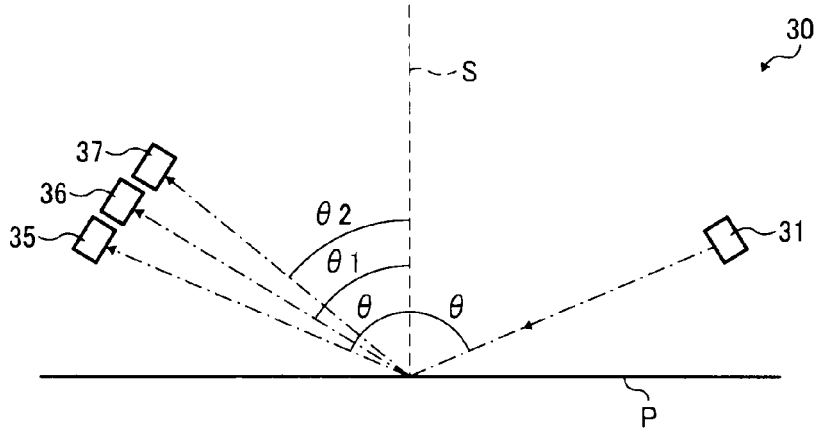
FIG. 4 is a schematic diagram illustrating an optical detector including a single light emitter and a plurality of light receivers according to an illustrative embodiment of the present invention.

Referring now to FIG. 4, there is provided a schematic diagram illustrating an example of an optical detector 30 according to one illustrative embodiment of the present invention. The optical detector 30 serves as at least one of a glossiness detector and a space detector that detects a space between asperities on the recording medium.

As illustrated in FIG. 4, the optical detector 30 includes one light emitter 31 and a plurality of light receivers 35, 36, and 37. According to the illustrative embodiment, three light receivers 35, 36, and 37 are provided.

A pair consisting of the light emitter 31 and the light receiver 35 is disposed such that the angle θ is formed between the light emitter 31 and the vertical line S, and between the light receiver 35 and the vertical line S. The light emitter 31 illuminates the recording medium with light, and the specularly reflected light is received by the light receiver 35. The angle θ between the light emitter 31 and the vertical line S, and the angle θ between the light receiver 35 and the vertical line S are the same.

By contrast, the diffuse light is light reflected by the projections on the recording medium on the light receiver 35 side. The diffuse light is most likely reflected in a direction that forms a smaller angle with the vertical line S than the angle θ described above. Therefore, the light receiver 36 and the light receiver 37 are disposed so that an angle θ1 formed between the light receiver 36 and the vertical line S, and an angle θ2 formed between the light receiver 37 and the vertical line S are configured smaller than the angle θ, and the angle θ1 and the angle θ2 are different from each other.

When the asperities on the surface of the recording medium are significant, it is most likely that the diffuse light is reflected towards the side forming a smaller angle from the vertical line S. Thus, a distribution of intensity of the reflected light (the diffuse light) is obtained based on the intensity of the light at the plurality of the light receivers 35, 36, and 37, thereby making it possible to identify the degree of roughness of (projections on) the surface of the recording medium.

Figure 5:
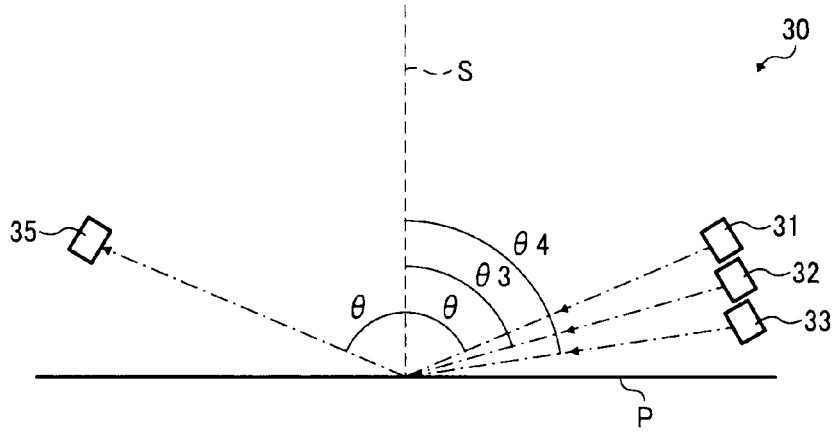
FIG. 5 is a schematic diagram illustrating an optical detector including a plurality of light emitters and a single light receiver according to an illustrative embodiment of the present invention.

Referring to FIG. 5, there is provided a diagram schematically illustrating a variation of the foregoing embodiment. According to the present variation, the optical detector 30 includes a plurality of light emitters 31, 32, and 33, and one light receiver 35.

When the plurality of the light emitters 31, 32, and 33 are provided, the pair consisting of the light emitter 31 and the light receiver 35 is disposed such that the angle θ is formed between the light emitter 31 and the vertical line S, and between the light receiver 35 and the vertical line S. The angle θ between the light emitter 31 and the vertical line S, and the angle θ between the light receiver 35 and the vertical line S are the same.

An angle θ3 between the light emitter 32 and the vertical line S, and an angle θ4 between the light emitter 33 and the vertical line S, are greater than the angle θ. The angle θ3 and the angle θ4 are different.

In the present variation, the light emitter 31 illuminates the recording medium with light, and the specularly reflected light is received by the light receiver 35. By contrast, the light receiver 35 receives the reflected light (diffuse light) from the light emitters 32 and 33 having the angles θ3 and θ4 greater than the angle θ, rather than from the light emitter 31 from which the light specularly reflected is received.

When the light emitters 31, 32, and 33 emit light at different angles with different timing, the light receiver 35 receives reflected light with different intensities. Accordingly, the distribution of intensity of the reflected light (diffuse light) can be obtained, thereby making it possible to identify the degree of roughness of (projections on) the surface of the recording medium.

The light emitters 32 and 33 are preferably provided at positions where the angle θ3 formed between the light emitter 32 and the vertical line S, and the angle θ4 formed between the light emitter 33 and the vertical line S, are greater than the angle θ formed between the light emitter 31 from which the specularly reflected light is received and the vertical line S.

As illustrated in FIGS. 4 and 5, when the plurality of the light emitters 32 and 33 or the plurality of the light receivers 36 and 37 are provided, the measured distribution of the reflected light becomes more precise. In other words, as the number of the light emitters or the light receivers increases, the measured distribution of the reflected light becomes more precise, thereby enabling precise identification of the surface condition of the recording medium.

However, when the number of the light emitters or the light receivers increases, the size of the optical detector and/or the cost of the optical detector also increase. Therefore, the place of installation of the optical detector and the cost should be taken into consideration when determining the number of the light receivers and the light emitters to be installed.

It is preferable that the light emitter 31 from which the light specularly reflected is emitted and the light receiver 35 that receives the specularly reflected light be provided such that the angle formed between the emitted light and the vertical line S perpendicular to the recording medium, and between the reflected light and the vertical line S, are in a range of 60 to 85 degrees. With this configuration, it is relatively easy to correlate reflectance with the surface condition of the recording medium.

Furthermore, when the plurality of light emitters and the light receivers are provided at different angles, the reflectance and the surface condition of the recording medium can be correlated with ease. When the light emitters and the light receivers are provided significantly out of that range, it may take time to determine the surface condition of the recording medium.

As will be later described in detail, according to the illustrative embodiment, in order to obtain a high-gloss image using high-gloss coated paper, an amount of toner adhered to an image can be changed based on the surface condition of the recording medium. Therefore, it is necessary to determine the surface condition of the recording medium before development of the image is initiated.

For this reason, the optical detector 30 is preferably provided before the pair of the registration rollers 22, and detects the recording medium fed from the sheet cassettes and the manual feed tray.

According to the illustrative embodiment, when glossiness of the recording medium is high and a space between the asperities on the recording medium is large relative to a weight average particle diameter of the toner, the amount of toner to be used to form the image is increased.

In general, when glossiness of the recording medium is relatively high, an image needs some glossiness. When glossiness of the recording medium is relatively low, but glossiness of the image is increased by changing the amount of toner, the image may appear uncomfortably glossy. To address this problem, according to the illustrative embodiment, when glossiness of the recording medium is high, it is determined whether or not the amount of toner to be used to form an image thereon needs to be changed.

According to the illustrative embodiment, when glossiness of the recording medium is greater than 5%, for example, the glossiness of the recording medium is considered as high. The decision as to whether or not the amount of toner is changed is made in accordance with the space between the asperities on the surface of the recording medium.

When the space between the asperities on the surface of the recording medium is small relative to the weight average particle diameter of the toner, the microscopic depressions in the surface of the recording medium are not filled with toner. Therefore, a smooth toner layer having a uniform height can be formed evenly on the surface of the recording medium, thereby enabling the surface of the image to be smooth after image fixation without changing the amount of toner adhered to the surface of the recording medium (See FIG. 6).

Figure 6:
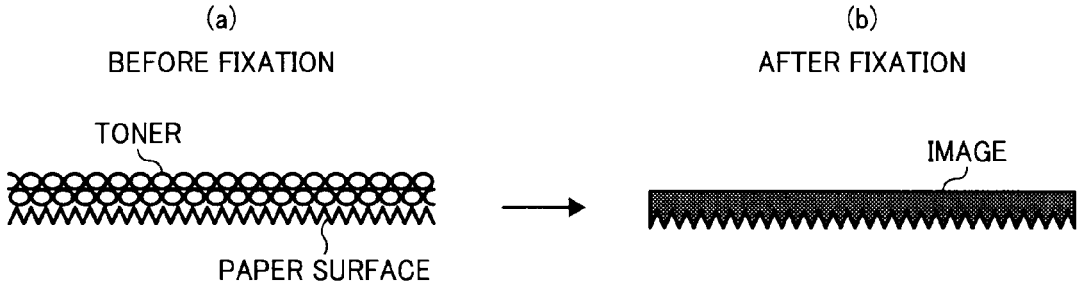
FIG. 6A is a conceptual diagram for explaining an example of a toner layer and a paper surface before image fixation.
FIG. 6B is a conceptual diagram for explaining one example of an image after image fixation.
Figure 7:
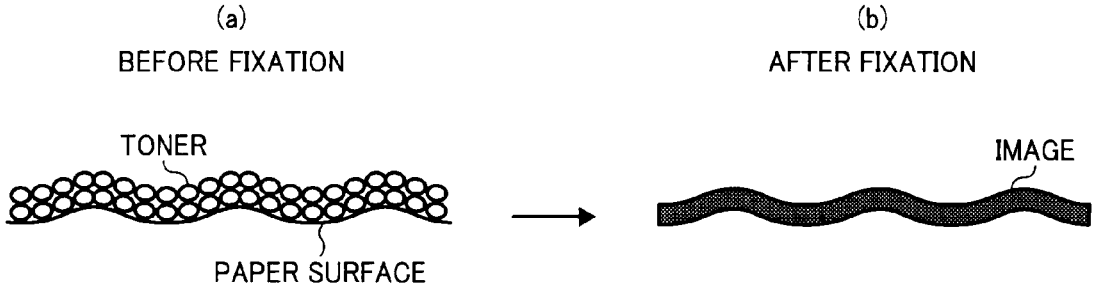
FIG. 7A is a conceptual diagram for explaining another example of the toner layer and the paper surface before image fixation.
FIG. 7B is a conceptual diagram for explaining another example of an image after image fixation.

By contrast, when the surface is smooth and the space between the asperities are large as is often seen in the high-gloss recording medium, the space between the asperities is greater than the diameter of the toner particles by a certain degree, and as a result, the toner layer readily conforms to the asperities on the surface of the recording medium. In this case, when the same amount of toner to form an image on the recording medium having a small space between the asperities on the surface thereof as shown in FIG. 6 is used, the amount of toner is not adequate to fill the depressions in the surface of the recording medium when the image is fixed. Consequently, an image having a smooth surface cannot be formed, making it difficult to obtain a high-gloss image (see FIG. 7(*b*)).

Figure 8:
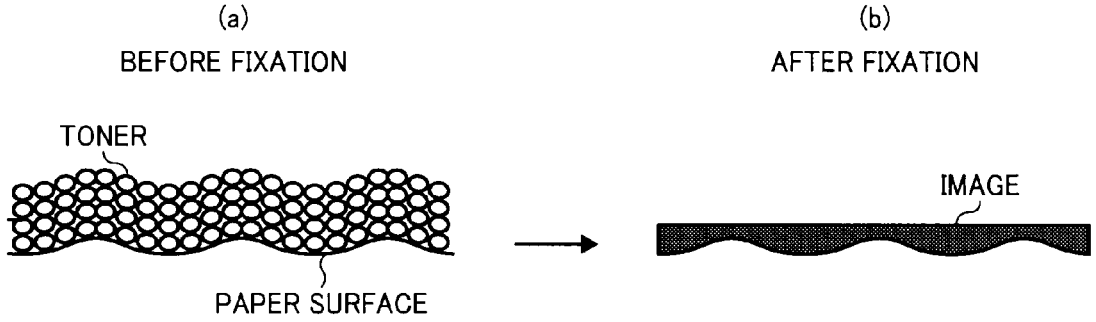
FIG. 8A is a conceptual diagram for explaining still another example of the toner layer and the paper surface before image fixation.
FIG. 8B is a conceptual diagram for explaining still another example of an image after image fixation.

According to the illustrative embodiment, when the space between the asperities is five times greater than the weight average particle diameter of toner, the space between the projections is considered to be large relative to the weight average particle diameter of toner. In this case, when the amount of toner to form an image is increased, the space between the projections on the recording medium can be filled with sufficient toner during image fixation, thereby forming an image with a smooth surface after the image is fixed, thereby obtaining a high-gloss image (See FIG. 8).

As the amount of toner is increased, a thickness of the toner layer is increased so that, during image fixation, the toner layer is pressed against the surface of the recording medium and fused, spreading over the surface of the recording medium in a horizontal direction. Accordingly, the space between the asperities is filled with toner, thereby forming a smooth surface and thus obtaining a high-gloss image.

In general, an appropriate amount of toner to be used to form an image suitable for each image forming apparatus, that is, an amount of toner per unit area, is determined in advance. Furthermore, the amount of toner is adjusted in accordance with the state of the apparatus, operating environment, and so forth. According to the illustrative embodiment, the amount of toner can be adjusted in accordance with the surface condition of the recording medium in addition to adjustment of toner described above.

In general, in order to obtain a high-gloss image, high-gloss paper is most likely used. Coated paper is commonly used as the high-gloss paper. The coated paper is formed such that the surface of paper produced by a paper machine is applied with a coating material by a coater. Subsequently, the surface of the coated paper is smoothened out by a supercalender serving as calendar, thereby increasing glossiness and smoothness of the surface of the coated paper.

The coating material includes mainly three major components: a pigment, an adhesive agent, and an auxiliary additive. 70% to 90% of the coating material consists of the pigment that is white inorganic material and determines smoothness, glossiness, whiteness, ink receptivity, and so forth. The pigment includes, but is not limited to clay, titanium oxide, and calcium carbonate.

The adhesive agent is used to adhere particles of the pigment while adhering the coating layer to a raw material. The adhesive agent includes, but is not limited to latex, starch, PVA, and so forth.

The auxiliary additive prevents a trouble of the pigment and the adhesive agent, and includes but is not limited to a pigment dispersing agent, an antifoam agent, an antiseptic agent, and a colorant.

The coated paper includes coated paper having the glossiness of 5% to 10% such as dull coated paper and matte coated paper. The coated paper also includes art paper the glossiness of which is 50% to 60%.

The surface of such high-gloss coated paper is very smooth having few asperities, thereby preventing toner from filling in the space between the asperities. Therefore, when the toner layer is adequately fused, a high gloss image can be obtained.

However, when the glossiness of image is too high, the image appears too glossy. Thus, it is desirable that the glossiness of the image be slightly higher than the glossiness of the coated paper. In other words, the amount of toner does not have to be increased in order to form a high-gloss image.

By contrast, in order to make a good gloss image using low-gloss coated paper, the degree of difference in glossiness of the recording medium and the image is preferably large, when compared with the high-gloss coated paper. Thus, the present invention is advantageous when using different types of coated paper such as dull coated paper having the glossiness of 5 to 10%, matte coated paper, and coated paper having the glossiness not more than 20%.

It is to be noted that there is such plain paper having the glossiness of 5 to 10%. In general, the plain paper is used when an image does not require gloss image or quality of image is not important. In addition, the plain paper is used to reduce cost.

According to the illustrative embodiment, whether or not coated paper is used can be determined. For example, according to the illustrative embodiment, the image forming apparatus 100 includes a coated paper recognition device 140 such as a control panel in which a user can designate use of coated paper.

When the user designates coated paper, glossiness and the surface condition of the paper is detected. By contrast, when the recording medium is not recognized as coated paper by the coated paper recognition device 140, detection of the surface condition is not performed, thereby reducing unnecessary operation.

Furthermore, when an image is formed on plain paper so as to reduce cost, the amount of toner is not increased, thereby reducing cost in keeping with the original intent to use plain paper.

According to the illustrative embodiment, it is particularly effective to use small-particle toner having a weight average particle diameter of equal to or greater than 3.0 and less than 6.0 μm. In order to obtain such toner, the polymerization method is frequently used.

Circularity of toner particles produced by the polymerization method is relatively high, and the content of fine powder and coarse grains is less than that of the pulverization method. Therefore, when the space between asperities on the surface of paper is small, the amount of toner that fills the space is not significant, thereby forming the toner layer more evenly than that in the pulverization method.

By contrast, when the space between asperities on the surface of paper is large, the toner particles can readily fill the depressions in the surface of the paper, thereby forming an image that reflects the surface roughness of the recording medium, which is undesirable. As a result, the difference in the space between the asperities causes a significant difference in glossiness of the image when using toner having a small weight average particle diameter.

In view of the above, the present invention is particularly effective when using toner having a weight average particle diameter of approximately 3.0 to 6.0 μm. Furthermore, the present invention is even more effective when the ratio of the weight average particle diameter to a number average particle diameter is from 1.0 to less than 1.2, and the circularity of the toner particle is in a range of 0.95 to 1.00.

When such toner is used, dot reproduction is enhanced. The distribution of the particle diameter is sharpened, thereby stabilizing charging amount. When the circularity is enhanced, transferability is also improved. As a result, high imaging quality can be attained with ease.

Next, based on detection of reflected light from the surface of the paper by the optical detector 30, the surface profile of the recording medium is identified and it is determined whether or not the amount of toner to be used to form an image on the recording medium needs to be changed.

Figure 9:
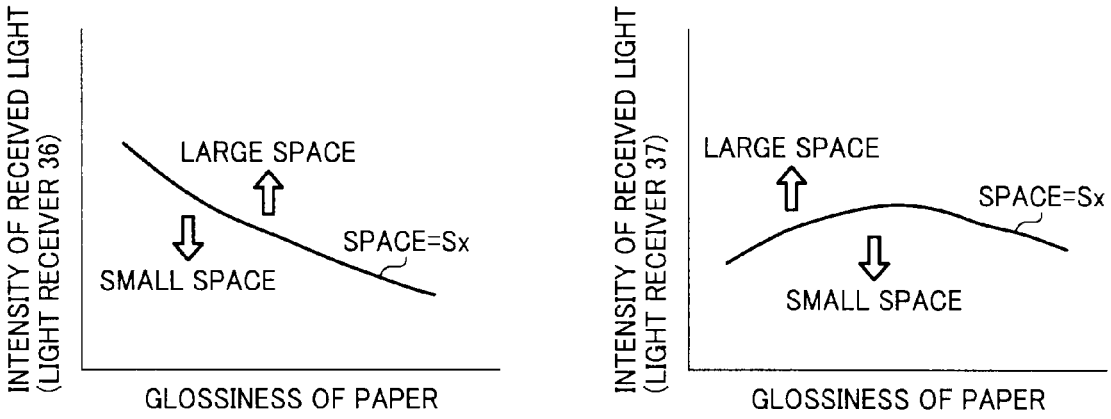
FIG. 9 is a graphical representation of a relation between glossiness of paper and intensity of light received by light receivers, according to an illustrative embodiment of the present invention.

Intensities of both the specularly reflected light and the diffuse light received by the optical detector 30 is measured in advance for different types of known paper to provide reference values. The glossiness and space between asperities of the paper are generally known. Therefore, a correlation between glossiness and the space between asperities of the paper is determined in advance. Accordingly, for every degree of glossiness of the paper, the intensity of the diffuse light that the light receiver that receives can be identified when the space between asperities of the paper is a value Sx, where Sx refers to a value five times greater than the weight average particle diameter of the toner to be used (See FIGS. 9A and 9B).

Based on the correlation described above, a plot of the intensity of the diffuse light received at the diffuse light receiver and whether or not the space between asperities on the surface of the paper is greater than Sx are identified. Subsequently, whether or not the amount of toner to be used to form an image is changed (increased) is determined.

Figure 10:
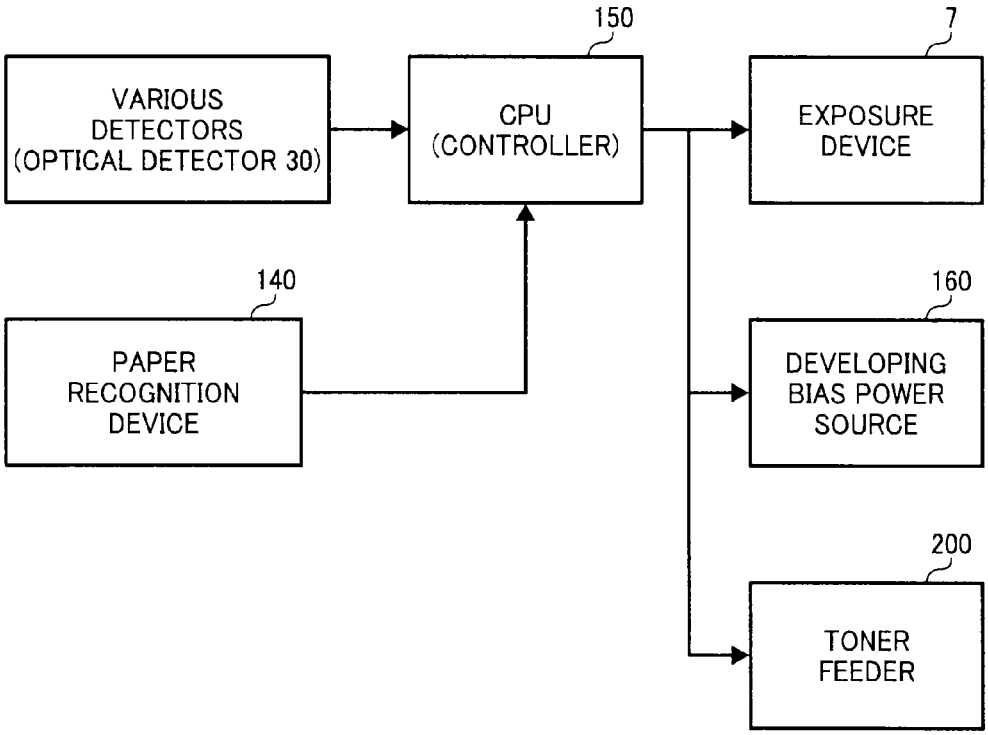
FIG. 10 is a block diagram illustrating control of an amount of toner according to an illustrative embodiment of the present invention.

Referring to FIG. 10, there is provided a block diagram illustrating control of an amount of toner to be used. As illustrated in FIG. 10, the image forming apparatus 100 includes a CPU 150 serving as a controller that controls an amount of toner to be fed by a toner feeder 200 in accordance with detection of paper by the optical detector 30.

Figure 11:
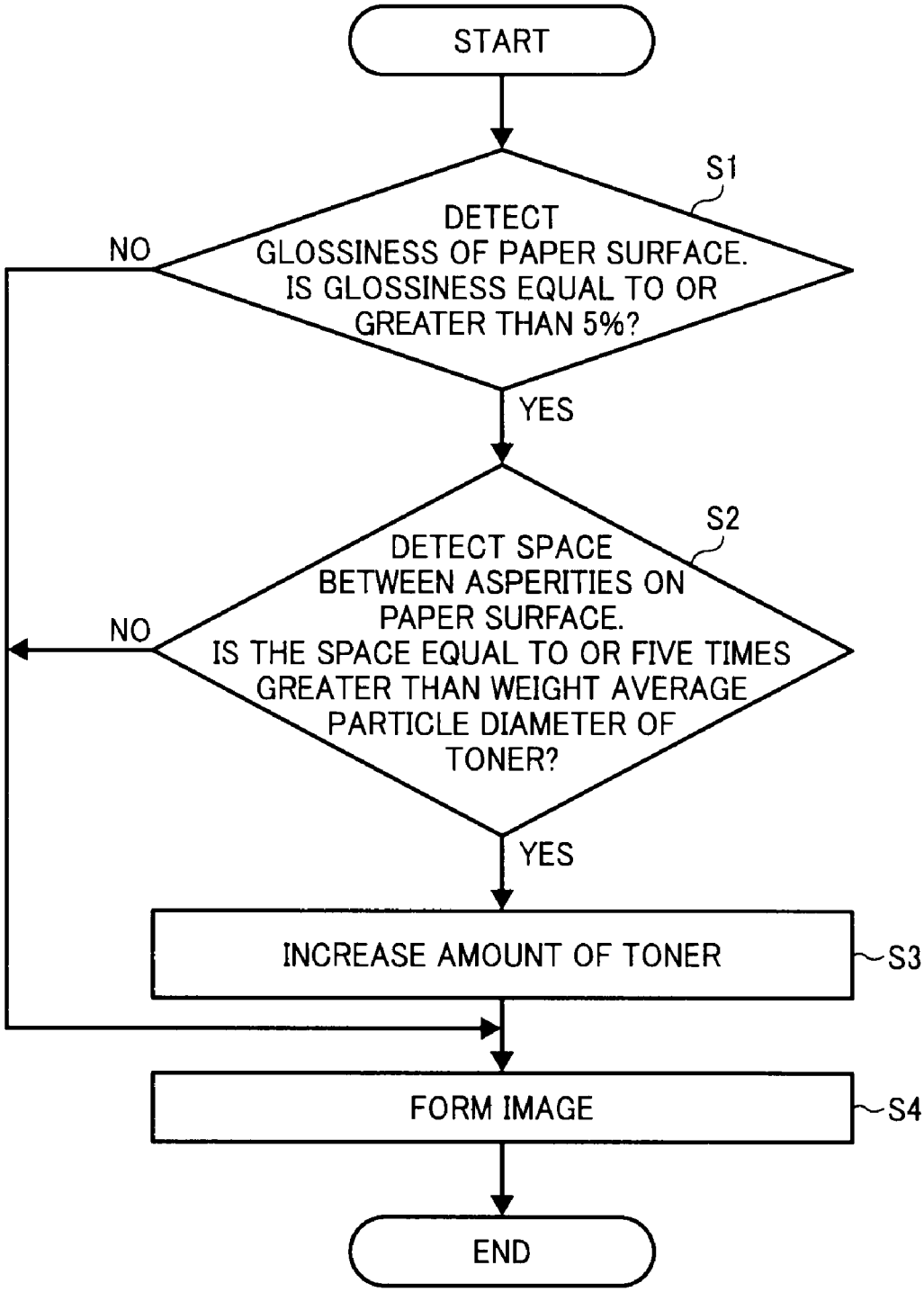
FIG. 11 is a flowchart illustrating an exemplary procedure for control of an amount of toner according to an illustrative embodiment of the present invention.

Referring now to FIG. 11, there is provided a flowchart showing an exemplary procedure for determining whether the amount of toner to be used is increased based on detection of paper by the optical detector 30 illustrated in FIG. 4. The optical detector 30 according to the present embodiment includes one light emitter 31 and three light receivers 35, 36, and 37.

First, at step S1, glossiness of paper is identified based on a detection result of the light receiver 35 that receives light emitted from the light emitter 31 onto the paper and reflected therefrom. When the glossiness of the paper is determined to be less than a predetermined value (NO at step S1), the process proceeds to step S4 where normal image forming operation is performed.

By contrast, when glossiness of the paper is determined to be equal to or greater than a predetermined value at step S1 (YES at step S1), at step S2 it is determined whether or not the space between asperities of the paper is five times greater than the weight average particle diameter of the toner based on a detection result of a plurality of the light receivers, that is, the light receivers 36 and 37.

When the space between asperities of the paper is determined to be less than the predetermined value, that is, the space is not five times greater than the weight average particle diameter of the toner (NO at step S2), for example, the process proceeds to step S4 where normal image forming operation is performed.

By contrast, at step S2, when it is determined that the space between asperities of the paper is equal to or greater than the predetermined value (Yes at step S2), the amount of toner to be used for forming an image is changed (increased) at step S3. Subsequently, image forming operation is performed using the increased toner amount.

In a case in which the optical detector 30 illustrated in FIG. 5 is used, at step S2, the plurality of light emitters 31, 32, and 33 sequentially emit light, and the light receiver 35 detects the reflected light sequentially from the light emitters 31, 32, and 33. Subsequently, the space between asperities on the surface of the paper is identified, and it is determined whether the space between the asperities is five times greater than the weight average particle diameter of toner.

Figure 12:
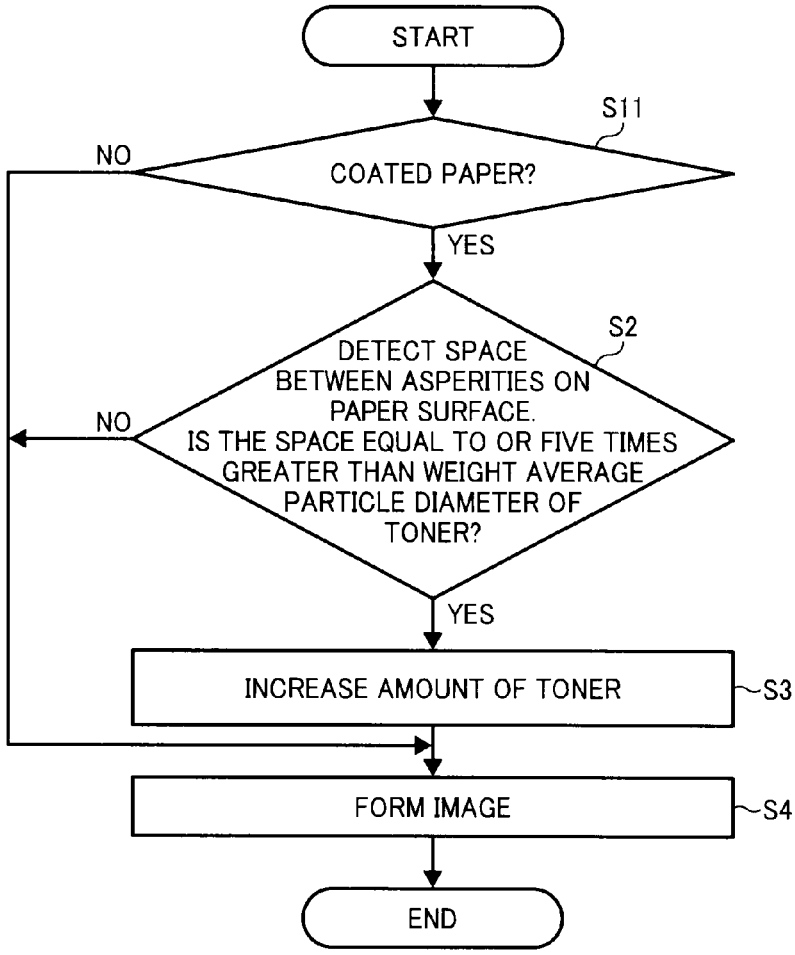
FIG. 12 is a flowchart illustrating another exemplary procedure for control of an amount of toner according to an illustrative embodiment of the present invention.

Referring now to FIG. 12, there is provided a flowchart showing an exemplary procedure for determining whether the amount of toner to be used to form an image is increased in the image forming apparatus in which the coated paper recognition device 140 recognizes the coated paper according to the illustrative embodiment.

First, at step S1, it is determined whether coated paper is designated. When it is determined that coated paper is not designated (NO at step S1), the process proceeds to step S4 where normal image forming operation is performed.

By contrast, when coated paper is designated (YES at step S1), at step S2, based on the detection result of the plurality of the light receivers 36 and 37 it is determined whether or not the space between asperities on the surface of the paper is five times greater than the weight average particle diameter of the toner. When it is determined that the space is not five times greater than the weight average particle diameter (No at step S2), the process proceeds to step S4 where normal image forming operation is performed.

By contrast, when it is determined that the space between the asperities of the paper is five times greater than the weight average particle diameter of the toner (Yes at step S2), at step S3, the amount of toner to be used is changed (increased). Subsequently, the process proceeds to step S4 and image forming operation is performed using the increased toner amount.

The optical detector 30 illustrated in FIG. 4 is used in the exemplary procedure for FIG. 12. The optical detector 30 according to the present embodiment includes one light emitter 31 and three light receivers 35, 36, and 37. Alternatively, the optical detector 30 illustrated in FIG. 4 can be employed. In this case, at step S2, the plurality of light emitters 31, 32, and 33 sequentially emit light, and the light receiver 35 detects the reflected light sequentially from the light emitters 31, 32, and 33. Subsequently, the space between asperities of the paper is identified, and it is determined whether or not the space between asperities of the paper is five times greater than the weight average particle diameter of toner.

As illustrated in FIGS. 11 and 12, detection of the glossiness and the space between asperities on the surface of the paper can be determined based on a single detection result (reading) obtained by the optical detector 30.

Alternatively, the number of detections (readings) can be increased, and the glossiness of paper and the space between asperities thereof can be determined based on multiple detection results (readings). Although it takes more time than the single detection, detection accuracy is enhanced and a high quality image is obtained with ease.

The degree by which the toner is increased is preferably less than 20% relative to an original amount of toner. More preferably, the increase in the amount of toner is in a range of 5% to 15% relative to an original amount of toner. When the toner is increased by more than 20%, the toner cannot be adequately fused onto the surface of the recording medium and a smooth toner layer is not formed. As a result, desirable gloss cannot be obtained.

Changing the amount of toner to form an image means changing the amount of toner to be adhered to the photoreceptor drum. Various methods are known to regulate the amount of toner that adheres to the photoreceptor drum. The known methods include, for example, changing a potential of development, changing an alternating-current voltage waveform as a developing bias, changing a toner concentration in the developer in the developing device, and so forth.

Figure 13:
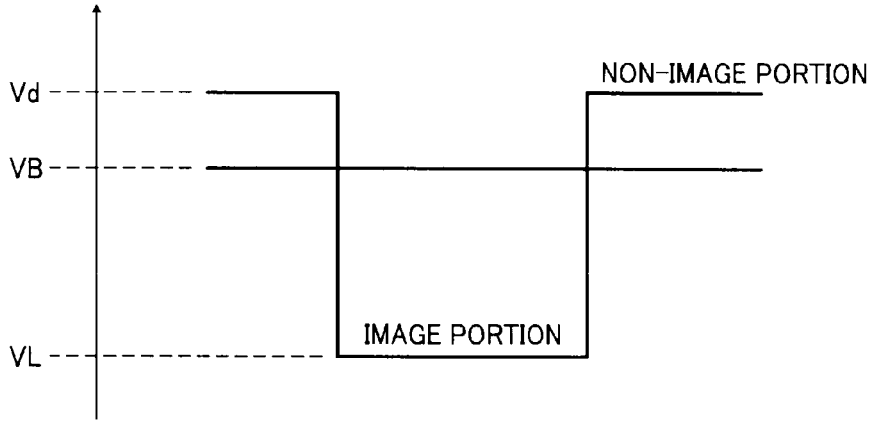
FIG. 13 is a chart showing a surface potential of a photoreceptor drum when an electrostatic latent image is formed thereon.

Referring now to FIG. 13, there is provided a diagram schematically illustrating a surface potential of the photoreceptor drum on which an electrostatic latent image is formed. With reference to FIG. 13, a description is provided of a relation between a development parameter and the amount of toner adhered to the photoreceptor drum.

As illustrated in FIG. 13, when the electrostatic latent image is formed on the surface of the photoreceptor drum, the potential of an image portion where the electrostatic latent image is exposed changes. The image herein refers to a solid image. VL is the potential of the surface of the photoreceptor drum. Vd is a potential of a non-image area. An arrow points in a negative direction.

Subsequently, the electrostatic latent image arrives at a developing region opposite a developing roller. While rotating at a higher linear velocity than that of the photoreceptor drum, the developing roller transports the developer including toner to the developing region, and is supplied with DC voltage or AC voltage as the developing bias supplied by a developing bias power source 160. Accordingly, toner adheres to the electrostatic latent image on the photoreceptor drum, forming a visible image known as a toner image.

Figure 14:
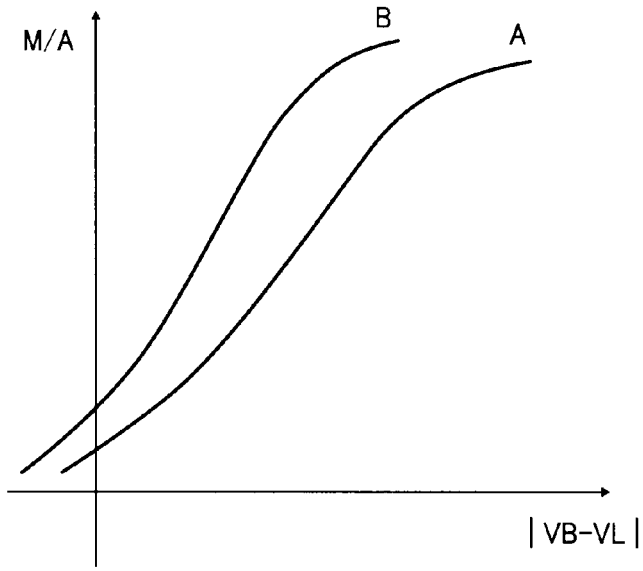
FIG. 14 is a graphical representation for explaining developability.

The amount of toner adhered to the photoreceptor drum, also referred to as developability, can be changed depending on a development potential |VB−VL| that is an absolute value of a difference between the developing bias VB and the potential VL of a latent image. FIG. 14 is a graphical representation of developability. In FIG. 14, a horizontal axis is the development potential |VB−VL|, and a vertical axis is the amount of toner adhered to the photoreceptor drum surface (M/A). FIG. 14 shows a case in which DC voltage is supplied as the developing bias by the developing bias power source 160.

There are three ways, A, B, and C, to change the amount of toner adhered to the photoreceptor drum:

A. The potential VL of the exposure portion is reduced (close to 0) by increasing an exposure energy when the exposure device performs exposure; and B. The developing bias VB is increased. That is, the developing bias VB is kept away from the potential VL;

C. A combination of both A and B is performed.

Method A is advantageous in that the amount of the toner adhered to the photoreceptor drum can be changed by extending an exposure period of the exposure device (LD and LED) or the intensity of light emission. With this configuration, it is not necessary to change developing conditions.

In method B, the amount of the toner adhered to the photoreceptor drum can be changed while reliably maintaining the difference between the potential of the non-image portion and the developing bias potential, without undesirably adhering toner to the non-image portion.

Figure 15:
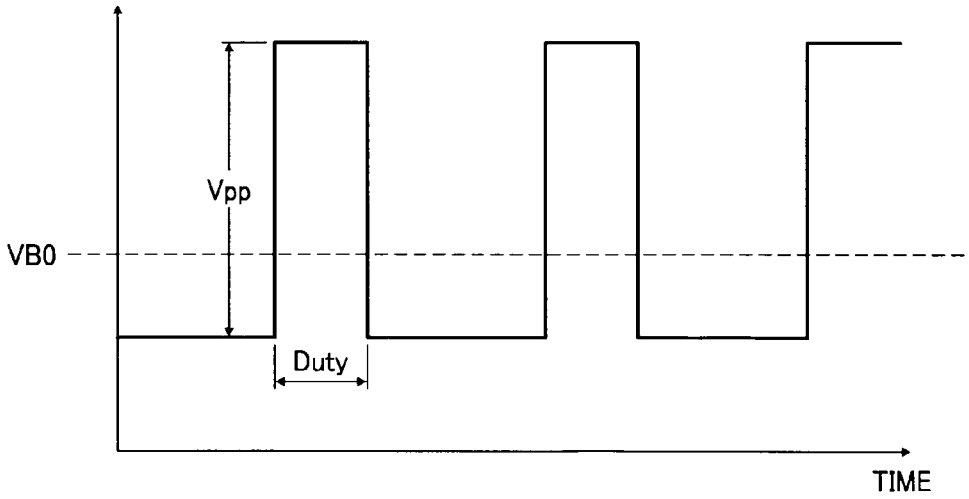
FIG. 15 is a waveform showing an example of an AC developing bias.

Alternatively, an AC developing bias, in which the AC voltage is superimposed on the DC voltage, can be used as the developing bias. An example of the AC developing bias is shown in FIG. 15. Each parameter of the waveform shown in FIG. 15 is as follows:

Average DC voltage VB0=−500 V;

Peak-to-peak voltage Vpp=0.8 kV;

Frequency f=4.5 kHz;

Duty=35%

"Duty" herein indicates a ratio of time during which a voltage is applied so as to develop toner to total time of one cycle, when total time of one cycle is 100%).

The average DC voltage herein indicates an average voltage of the waveform and can be expressed by the following equation:

$$VB0=V0+(50-\text{Duty})/100\times Vpp \qquad \text{Equation 1}$$

where V0 is a center of the waveform.

In the case of such an asymmetric rectangular voltage waveform, the amount of toner adhered to the photoreceptor drum can be changed significantly by changing the parameters Vpp and Duty except VB0. It is to be noted that this value does not define the waveform of the AC developing bias. Alternatively, a different value can be used. Furthermore, other waveforms, such as a sine waveform, a triangular waveform, and a pulse waveform, can be used.

Developability can also be enhanced by increasing a toner density in the developing device. The toner density refers to a ratio of toner in weight relative to the weight of developer consisting of toner and carrier in the developing device. The developer herein refers to a two-component developer including toner and carrier.

When supplying toner from a toner feeder 200, the ratio of toner in the developer is increased so as to increase the amount of toner in the developing region, thereby enhancing developability. For example, as illustrated in FIG. 14, developability is increased from Line A to Line B. It is to be noted that the degree by which toner is increased is within a range in which undesirable toner dispersion does not occur in the developing device.

According to the illustrative embodiment, different types of coated paper can be selected. In addition, it is preferable that thicknesses can be selected as well. In order to obtain a high gloss image, toner needs to be adequately fused. Whether the toner is adequately fused depends largely on a thickness of paper.

As described above, coated paper is coated with a coated material. Thus, the coated paper tends to be thicker than plain paper. In view of this, when print conditions such as the transfer condition, and in particular, the fixing condition are changed in accordance with a thickness of paper, a high-quality image can be obtained using coated paper with ease.

According to the illustrative embodiment, toner to be used includes at least a binder resin and a coloring agent. Toner may include a charge controlling agent, a release agent, and a magnetic material as necessary. As an external additive, a fluidity enhancing agent and a cleaning aid may be added.

Toner is manufactured by generally-known methods including the pulverization method and the polymerization method that became popular in recent years. In the pulverization method, known toner constituent materials that are fused, mixed, and kneaded are pulverized. As the two-component developer, toner is mixed with carrier covered with a resin such as magnetic powder.

Experiments were performed with four different types of paper, two different toners, and two different image forming apparatuses. The developer was manufactured such that toner was mixed with silicone-coated carrier having a core material formed of ferrite, and the toner density was 7% by weight.

[Paper]

Paper used in the experiments was as follows.

Paper 1: Coated paper, Glossiness 11%, Space between asperities 5 μm.

Paper 2: Coated paper, Glossiness 10%, Space between asperities 27 μm.

Paper 3: Coated paper, Glossiness 31%, Space between asperities 3 μm.

Paper 4: Non-coated paper, Glossiness 4%, Space between asperities 26 μm.

Glossiness of paper was measured with an incident angle of 60° using a glossmeter manufactured by Nippon Denshoku Industries Co., Ltd. An average of glossiness at five locations was obtained as the glossiness of paper.

The space between asperities on the surface of paper was measured at five locations using a surface roughness measuring instrument Surfcom 1500SD manufactured by TOKYO SEIMITSU CO., LTD, and an average space Sm was obtained. The surface roughness was measured at a distance of 5 mm and a speed of 0.3 mm/sec.

[Toner]

Toner used in the experiments was as follows:

Toner 1: Weight average particle diameter 7 μm, Ratio of weight average particle diameter and number average particle diameter 1.18, Average circularity 0.92.

Toner 2: Weight average particle diameter 5 μm, Ratio of weight average particle diameter and number average particle diameter 1.14, Average circularity 0.96.

The weight average particle diameter, and the ratio of the weight average particle diameter and the number average particle diameter were measured using Coulter Multisizer II, manufactured by Coulter Co. in a following method.

First, a surface active agent, preferably, 0.1 to 5 ml of sodium alkylbenzen sulfonate, was added as dispersant in 100 to 150 ml of an aqueous electrolytic solution. The electrolytic solution herein refers to approximately 1% of a NaCl aqueous solution prepared by using a first-grade sodium chloride. For example, ISOTON-II manufactured by Coulter Co. can be used.

Furthermore, 2 to 20 mg of a test sample was added to the resulting mixture. The electrolytic aqueous solution with the sample was dispersed for about 1 to 3 minutes by an ultrasonic disperser. The weight and the number of the toner particles or toner were measured by Coulter Multisizer II with a 100-μm aperture, and the weight distribution and the number distribution were calculated. The weight average particle diameter (D4) and the number average particle diameter (D1) of the toner were determined from the obtained distributions.

As for channels, there were used thirteen channels in total, e.g., a channel of 2.00 μm to less than 2.52 μm, a channel of 2.52 μm to less than 3.17 μm, a channel of 3.17 μm to less than 4.00 μm, a channel of 4.00 μm to less than 5.04 μm, a channel of 5.04 μm to less than 6.35 μm, a channel of 6.35 μm to less than 8.00 μm, a channel of 8.00 μm to less than 10.08 μm, a channel of 10.08 μm to less than 12.70 μm, a channel of 12.70 μm to less than 16.00 μm, a channel of 16.00 μm to less than 20.20 μm, a channel of 20.20 μm to less than 25.40 μm, a channel of 25.40 μm to less than 32.00 μm, and a channel of 32.00 μm to less than 40.30 μm. The particle diameter of equal to or greater than 2.00 μm to less than 40.30 μm was subjected to the channels.

The average circularity of toner was measured using flow-type particle image analyzer FPIA-1000 (manufactured by Toa Medical Electronics Co., Ltd.). 0.1 ml to 0.5 ml of surfactant (preferably alkylbenzenesulfonate) was added to 100 ml to 150 ml of an electrolytic aqueous solution from which solid impurities were removed in advance. Subsequently, approximately 0.1 to 0.5 g of the sample was added. The electrolytic aqueous solution with the sample was dispersed for about 1 minute to 3 minutes by the ultrasonic disperser. Accordingly, the dispersion concentration is adjusted to 3,000 to 10,000/μl, and then the shape of the toner was measured.

[Image Forming Apparatus]

Image forming apparatus 1 included the optical detector 30 for detecting the surface condition of paper, but types of coated paper were not selectable.

Image forming apparatus 2 included the optical detector 30 for detecting a surface condition of paper and types of coated paper were selectable.

Image forming apparatus 3 did not include a detector for detecting a surface condition.

The image forming apparatuses 1 and 2 employed the optical detector 30 illustrated in FIG. 4. The optical detector 30 included the plurality of light receivers 35, 36, and 37.

According to the illustrative embodiment, the light emitter 31 is provided so as to irradiate the paper at an angle of 60° relative to a vertical line of the paper. One of the light receivers is provided to receive the specularly reflected light reflected at an angle of 60° relative to a vertical line of the paper. The rest of the light receivers are provided to receive diffuse light reflected at angles of 50° and 40° relative to the vertical line of the paper.

Embodiment 1

Paper 1 was set to the manual feed tray of the image forming apparatus 1. Images were printed using a developer including the toner 1. The images included one-inch square of a solid patch for each of the colors yellow, cyan, magenta, and black; one-inch square of a two-color overlapped solid patch for R, G, and B; one-inch square of one-dot line grid (600 dot/inch and 150 line/inch) for each of the colors yellow, cyan, magenta, and black; and a portrait image, provided on A4-size paper.

Embodiment 2

Paper 1 was set to the manual feed tray of the image forming apparatus 1. Images were printed using a developer including the toner 2. The same images as the Embodiment 1 were printed.

Embodiment 3

Paper 2 was set to the manual feed tray of the image forming apparatus 1. Images were printed using the developer including the toner 1. The same images as the Embodiment 1 were printed.

Embodiment 4

Paper 2 was set to the manual feed tray of the image forming apparatus 1. Images were printed using the developer including the toner 2. The same images as the Embodiment 1 were printed.

Comparative Example 1

Paper 2 was set to the manual feed tray of the image forming apparatus 3. Images were printed using the developer including the toner 2. The same images as the Embodiment 1 were printed.

Embodiment 5

Paper 3 was set to the manual feed tray of the image forming apparatus 2. Coated paper was selected, and images were printed using the developer including the toner 2. The same images as in Embodiment 1 were printed.

Reference Example

Paper 4 was set to the manual feed tray of the image forming apparatus 2. Coated paper was NOT selected, and images were printed using the developer including the toner 2. The same images as in Embodiment 1 were printed.

As shown in TABLE 1, glossiness, reproducibility of fine lines, and sensitivity were evaluated for the images described above. Glossiness was measured such that glossiness substantially near the center of the solid patch of R, G, and B of the obtained image was measured using the same device used to measure the glossiness of the paper, and an average was obtained.

The reproducibility of fine lines was visually evaluated based on image defects such as fading and voids, and categorized into three different levels: "Very Good", "Good", and "Bad".

The sensitivity of the images was evaluated such that 10 people arbitrarily selected were asked to categorize the images into images that were felt to be high quality and images that were felt to be not high quality.

The evaluation results are shown in TABLE 1.

| | IMAGE GLOSSINESS % | DIFFERENCE IN GLOSSINESS OF PAPER % | FINE-LINE REPRODUCIBILITY LEVELS | NUMBER OF PEOPLE WHO DETERMINED THE IMAGE WAS HIGH QUALITY NUMBER/10 PEOPLE |
|---|---|---|---|---|
| EMBODIMENT 1 | 31 | +20 | GOOD | 7 |
| EMBODIMENT 2 | 31 | +20 | VERY GOOD | 8 |
| EMBODIMENT 3 | 27 | +17 | GOOD | 6 |
| EMBODIMENT 4 | 28 | +18 | VERY GOOD | 8 |
| COMPARATIVE EXAMPLE 1 | 14 | +4 | VERY GOOD | 0 |
| EMBODIMENT 5 | 50 | +19 | VERY GOOD | 8 |
| REFERENCE EXAMPLE | 7 | +3 | VERY GOOD | 2 |

According to EMBODIMENT 1, glossiness of the images was high relative to the paper. Many evaluators felt that the images were high quality.

According to EMBODIMENT 2, because the particle distribution and the shape of the toner were different from EMBODIMENT 1, an original document was more accurately reproduced than EMBODIMENT 1. Many evaluators felt that the images were high quality.

According to EMBODIMENT 3, a coated paper different from the coated paper used in EMBODIMENTS 1 and 2 was used. The glossiness of the image was high relative to the paper. Many evaluators felt that the images were high quality.

According to EMBODIMENT 4, because the particle distribution and the shape of the toner were different from EMBODIMENT 3, an original document was more accurately reproduced than EMBODIMENT 3. Many evaluators felt that the images were high quality.

According to COMPARATIVE EXAMPLE 1, the same paper and the toner as that of EMBODIMENT 4 were used. However, the image forming apparatus 3 according to COMPARATIVE EXAMPLE 1 did not detect the surface condition of the paper so that desirable image glossiness was not obtained. No evaluator felt that the images were high quality.

According to EMBODIMENT 5, the glossiness of the image was high relative to the paper. Many evaluators felt that the images were high quality.

According to REFERENCE EXAMPLE, the reproducibility of fine lines was good. However, glossiness was low. A few evaluators felt that the images were high quality. The image forming apparatus of REFERENCE EXAMPLE did not detect the surface condition of the paper, thereby reducing time to print the images when compared with EMBODIMENTS 1 through 4. This means that when no gloss is required, the original document can be accurately reproduced in a short period of time.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear an electrostatic latent image on a surface thereof;

a developing device disposed adjacent to the image bearing member to develop the electrostatic latent image formed on the image bearing member using toner to form a toner image;

a transfer device to transfer the toner image onto a recording medium;

a fixing device to fix the toner image;

a first detector to detect at least glossiness of a surface of the recording medium;

a second detector to detect at least a space between asperities on the surface of the recording medium; and a controller to control an amount of toner when forming the toner image, wherein the controller adjusts the amount of toner based on the glossiness of the recording medium detected by the first detector and the space between the asperities detected by the second detector, and wherein the controller increases the amount of toner when the glossiness detected by the first detector is equal to or greater than a predetermined value and the space between the asperities detected by the second detector is equal to or greater than a predetermined multiple of weight average particle diameter of the toner.

2. The image forming apparatus according to claim 1, wherein at least one of the first detector and the second detector detects both glossiness and the space between the asperities on the surface of the recording medium.

3. The image forming apparatus according to claim 1, wherein at least one of the first detector and the second detector is an optical detector, the optical detector including a plurality of light emitters and a single light receiver.

4. The image forming apparatus according to claim 3, wherein at least a pair consisting of one of the plurality of light emitters and the light receiver is disposed such that an angle formed between irradiated light emitted from the light emitter and a vertical line perpendicular to the recording medium, and an angle formed between reflected light received by the light receiver and the vertical line perpendicular to the recording medium are the same, and other light emitters are disposed at angles different from the angle formed between reflected light received by the light receiver and the vertical line perpendicular to the recording medium.

5. The image forming apparatus according to claim 1, wherein at least one of the first detector and the second detector is an optical detector, the optical detector including a plurality of the light receivers and a single light emitter.

6. The image forming apparatus according to claim 5, wherein at least a pair consisting of one of the plurality of light receivers and the light emitter is disposed such that an angle formed between irradiated light emitted from the light emitter and a vertical line perpendicular to the recording medium and an angle formed between reflected light received by the light receiver and the vertical line perpendicular to the recording medium are the same, and other light receivers are disposed at angles different from the angle formed between irradiated light emitted from the light emitter and the vertical line perpendicular to the recording medium.

7. An image forming apparatus, comprising:

an image bearing member to bear an electrostatic latent image on a surface thereof;

a developing device to develop the electrostatic latent image formed on the image bearing member using toner to form a toner image;

a transfer device to transfer the toner image onto a recording medium;

a fixing device to fix the toner image;

a paper recognition device to identify a type of paper used as the recording medium;

a space detector to detect a space between asperities on the surface of the recording medium;

a controller to control an amount of toner when forming the toner image, wherein the controller adjusts the amount of the toner based on the type of paper used as the recording medium and the space between the asperities detected by the space detector, and wherein when the paper recognition device identifies the recording medium as coated paper and the space between the asperities detected by the space detector is equal to or greater than a predetermined multiple of weight average particle diameter of the toner, the controller increases the amount of toner.

8. The image forming apparatus according to claim 1, wherein the toner has a weight average particle diameter of less than 6 μm, a ratio of volume average particle diameter and number average particle diameter of less than 1.2, and an average circularity equal to or greater than 0.95.

9. A method of forming an image, comprising the steps of:

bearing an electrostatic latent image on a surface of an image bearing member;

developing the electrostatic latent image formed on the image bearing member using toner to form a toner image;

transferring the toner image onto a recording medium;

fixing the toner image;

detecting at least glossiness of a surface of the recording medium;

detecting at least a space between asperities on the surface of the recording medium; and adjusting an amount of toner when forming the toner image based on the glossiness of the recording medium detected in the detecting glossiness step and the space between the asperities detected in the detecting a space step, wherein the adjusting increases the amount of toner when the glossiness is equal to or greater than a predetermined value and the space between the asperities is equal to or greater than a predetermined multiple of a weight average particle diameter of the toner.

10. The method according to claim 9, wherein at least one of the detecting the glossiness and the detecting the space detects both the glossiness and the space between the asperities on the surface of the recording medium.

11. The method according to claim 9, wherein at least one of the detecting the glossiness and the detecting the space between the asperities is an optical detector, the optical detector including a plurality of light emitters and a single light receiver.

12. The method according to claim 11, wherein at least a pair consisting of one of the plurality of light emitters and the light receiver is disposed such that an angle formed between irradiated light emitted from the light emitter and a vertical line perpendicular to the recording medium and an angle formed between reflected light received by the light receiver and the vertical line perpendicular to the recording medium are the same, and other light emitters are disposed at angles different from the angle formed between the reflected light received by the light receiver and the vertical line perpendicular to the recording medium.

13. The method according to claim 9, wherein at least one of the detecting the glossiness and the detecting the space between asperities is an optical detector, the optical detector including a plurality of the light receivers and the single light emitter.

14. The method according to claim 13, wherein at least a pair consisting of one of the plurality of light receivers and the light emitter is disposed such that an angle formed between irradiated light emitted from the light emitter and a vertical line perpendicular to the recording medium and an angle formed between reflected light received by the light receiver and the vertical line perpendicular to the recording medium are the same, and other light receivers are disposed at angles different from the angle of the irradiated light emitted from the light emitter and a vertical line perpendicular to the recording medium.

* * * * *